US011259600B2

(12) United States Patent
Haughey

(10) Patent No.: US 11,259,600 B2
(45) Date of Patent: Mar. 1, 2022

(54) DEVICE FOR RETRACTABLE PISTON CLEATS

(71) Applicant: Michael William Haughey, Canton, MA (US)

(72) Inventor: Michael William Haughey, Canton, MA (US)

( * ) Notice: Subject to any disclaimer, the term of this patent is extended or adjusted under 35 U.S.C. 154(b) by 87 days.

(21) Appl. No.: 16/121,579

(22) Filed: Sep. 4, 2018

(65) Prior Publication Data

US 2018/0368529 A1 Dec. 27, 2018

Related U.S. Application Data

(63) Continuation-in-part of application No. 15/904,302, filed on Feb. 23, 2018, now abandoned.

(60) Provisional application No. 62/465,863, filed on Mar. 2, 2017.

(51) Int. Cl.

| | |
|---|---|
| ***A43C 15/14*** | (2006.01) |
| ***A43B 3/16*** | (2006.01) |
| ***A43C 15/06*** | (2006.01) |
| ***A43B 13/36*** | (2006.01) |

(52) U.S. Cl.

CPC ..... *A43C 15/14* (2013.01); *A43B 3/16* (2013.01); *A43B 13/36* (2013.01); *A43C 15/06* (2013.01)

(58) Field of Classification Search

CPC ..... A43C 15/14; A43C 15/06; A43B 3/16; A43B 13/36

USPC ..... 36/134, 61

See application file for complete search history.

(56) References Cited

U.S. PATENT DOCUMENTS

| | | | | |
|---|---|---|---|---|
| 1,487,976 A * | 3/1924 | Rossi | A43C 15/14 | 36/61 |
| 3,793,751 A * | 2/1974 | Gordos | A43C 15/14 | 36/61 |
| 3,816,945 A * | 6/1974 | Egtvedt | A43C 15/161 | 36/114 |
| 4,375,729 A * | 3/1983 | Buchanen, III | A43C 15/14 | 36/127 |
| 4,821,434 A * | 4/1989 | Chein | A43C 15/14 | 36/134 |

(Continued)

FOREIGN PATENT DOCUMENTS

| | | |
|---|---|---|
| CA | 2128880 C | 5/2002 |
| CN | 205696023 U | 11/2016 |

(Continued)

OTHER PUBLICATIONS

Weiss, C.C., , "Meindl builds a retractable spike system into its winter boots," http://newatlas.com/meindl-retractable-spike-boots/26174/, accessed on Feb. 1, 2017.

(Continued)

*Primary Examiner* — Khoa D Huynh
*Assistant Examiner* — Uyen T Nguyen
(74) *Attorney, Agent, or Firm* — Steven M. War

(57) ABSTRACT

A retractable piston cleat system which includes at least one inverted ramp in contact with and positioned to transition at least one piston cleat between a retracted and an extended position when a lever arm, or similar device, is moved between a first and a second position. In another embodiment, multiple inverted ramps are used to simultaneously transition multiple piston cleats between retracted and extended positions.

6 Claims, 15 Drawing Sheets

(56) References Cited

U.S. PATENT DOCUMENTS

| | | | | | |
|---|---|---|---|---|---|
| 4,825,562 | A * | 5/1989 | Chuang | A43C 15/14 | 36/134 |
| 5,269,080 | A | 12/1993 | Davis | | |
| 5,337,494 | A * | 8/1994 | Ricker | A43C 15/14 | 36/134 |
| 5,497,565 | A | 3/1996 | Balgin | | |
| 5,732,482 | A * | 3/1998 | Remington | A43C 15/14 | 36/127 |
| 5,870,838 | A * | 2/1999 | Khayat | A43C 15/14 | 36/61 |
| 5,956,870 | A * | 9/1999 | Grossman | A43C 15/14 | 36/127 |
| 6,058,627 | A * | 5/2000 | Violette | A43C 15/14 | 36/59 R |
| 7,490,418 | B2 | 2/2009 | Obeydani | | |
| 9,913,512 | B2 * | 3/2018 | Bachmann | A43C 15/02 | |
| 2006/0130372 | A1 * | 6/2006 | Auger | A43C 15/14 | 36/134 |

FOREIGN PATENT DOCUMENTS

| | | | |
|---|---|---|---|
| KR | 10-1494885 | B1 | 2/2015 |
| RU | 2416346 | C1 | 2/2010 |
| WO | WO 2015/120552 | A1 | 8/2015 |

OTHER PUBLICATIONS

International Search Report dated Jul. 11, 2018 in PCT/US2018/019587.

International Written Opinion dated Jul. 11, 2018 in PCT/US2018/019587.

* cited by examiner

DEVICE FOR RETRACTABLE PISTON CLEATS

RELATED APPLICATION

This application is a continuation-in-part of U.S. application Ser. No. 15/904,302 entitled Device for Retractable Piston Cleats, which claims the benefit of U.S. Provisional Application No. 62/465,863, filed Mar. 2, 2017 entitled Gearless Device to Extend and Retract Ice Studs From Within the Sole of a Shoe, both of which are hereby incorporated by reference in their entirety.

FIELD OF THE INVENTION

The present invention relates generally to retractable spikes, cleats, studs, or similar protrusions (collectively referred to herein as piston cleats) which are configured to extend beyond the surface of an object or to be retracted into the object and "housed" within the body of the object.

BACKGROUND OF THE INVENTION

At times, both children and adults desire specialized footwear for specific activities. For example, individuals wishing to play soccer desire soccer cleats for better performance on soccer fields. Similarly, individuals wishing to play football, typically desire football cleats for better traction on the football field. Many other types of specialize footwear are available including ice cleats for running, cleats for ice fishing, and cleats for ice and snow. However, one of the problems with specialized footwear is that it is difficult to perform different activities while wearing specialized footwear. Driving while wearing football cleats or ice cleats is difficult and dangerous and may cause damage to the brake or gas pedal. Additionally, specialized footwear may cause damage to incompatible surfaces when someone wearing that specialized footwear walks on the incompatible surface. Walking on marble tiles with ice cleats may cause irreparable damage to the marble tiles and may cause the user to slip and fall. The use of specialized footwear in some environments may be downright dangerous. Walking down a wooden staircase with football or soccer cleats may cause the individual to slide on the wooden stairs and to fall down the stairs. Walking on a carpeted staircase with ice cleats may cause the person to fall down the stairs if a cleat gets caught in the carpet.

In light of the inherent difficulties in wearing specialized footwear for other activities, many people wear non-specialized footwear until they arrive at the location where the use of specialized footwear is desired. Many adults will drive to their soccer game while wearing "normal" shoes (i.e., shoes without cleats), and once they arrive at the soccer field for their game or practice they will replace their normal shoes with their soccer cleats. Once the soccer practice or game is over, they typically change out of the specialized footwear and back to their normal shoes for the drive home. Even the act of changing from normal shoes to specialized shoes (or vice versa) is inconvenient and, in some cases, hazardous. Many times, one is forced to change shoes in the car (difficult at best), find another place to sit outdoors to change shoes, or attempt to balance on one foot while they change the shoe from their normal shoe to their specialized shoe on the other foot. Finding a suitable place to sit down outside to change shoes is also inconvenient in the rain, the cold, or in other non-ideal weather environments.

As a second example, when someone wishes to drive somewhere in icy conditions, they are forced (by safety concerns) to walk to the vehicle with specialized "ice cleats", and then replace these ice cleats with normal shoes for driving. Once the user arrives at his/her location, they are then forced (by safety concerns) to replace their normal shoes with their ice cleats to safely walk from their car to their destination in the icy conditions. A perfect example is a mailman (or women) who walks from house to house where some of the sidewalks are icy and others are passable without ice cleats. The result is often that a person would rather contend with a period of possibly slipping and falling while walking in icy conditions with non-specialized footwear than go through the hassle of changing their shoes to use specialized footwear.

Similarly, different types of tires may be desired for different types of road conditions. A driver may prefer to drive on tires with cleats in icy conditions or a different type of cleat in snowy conditions. Similarly, a driver of an all-terrain vehicle (ATV) may prefer to use cleats in icy conditions or different types of cleats in other conditions.

SUMMARY OF THE INVENTION

A retractable piston cleat system comprising at least one inverted ramp wherein the at least one inverted ramp includes at least a first portion, a second portion and a third portion; at least one piston cleat is in contact with the inverted ramp, the piston cleat includes a spring positioned so that at least a portion of the spring is positioned around at least a portion of the longitudinal axis of the piston cleat; and a lever arm which when activated causes the inverted ramp to transition between the first portion through the second portion and to the third portion thereby causing the piston cleat to move from a first position to a second position.

A method of moving a piston cleat between an extended position and a retracted position, the method comprising the steps of: positioning at least one inverted ramp such that the head of the piston cleat is in contact with a portion of the inverted ramp; connecting a lever arm to the inverted ramp such that movement of the lever arm causes movement to the inverted ramp; positioning a spring around a longitudinal axis of the piston cleat; wherein movement of the lever arm in a first direction causes the inverted ramp to move such that a highest portion of the inverted ramp is positioned above the head of the piston cleat; wherein movement of the lever arm in a second direction causes the inverted ramp to move such that a lowest portion of the inverted ramp is positioned above the head of the piston cleat; compressing a spring positioned around the longitudinal axis of the piston cleat when the lever arm is moved in such a way that the lowest portion of the inverted ramp is positioned above the head of the piston cleat; extending a bottom of the piston cleat such that a portion of the piston cleat is exposed when the lowest portion of the inverted ramp is positioned above the head of the piston cleat; and retracting the piston cleat such that no portion of the piston cleat is exposed when the highest portion of the inverted ramp is positioned above the head of the piston cleat.

A retractable piston cleat system comprising at least one ramp channel wherein the at least one ramp channel includes at least a first portion, a second portion and a third portion; at least one piston cleat including an oblong head wherein the oblong head of the at least one piston cleat is positioned within said ramp channel; and a lever arm which when activated causes said ramp channel to transition between the first portion through the second portion and to the third portion thereby causing the piston cleat to move from a first position to a second position.

BRIEF DESCRIPTION OF THE DRAWINGS

In the drawings, like reference characters generally refer to the same parts throughout the different views. The drawings are not necessarily to scale, rather emphasis is generally being placed upon illustrating the principles of various embodiments of the invention. The foregoing and other aspects of the invention will be better understood from the following description of embodiments of the invention, by way of example only, and with reference to the accompanying drawings, in which.

DETAILED DESCRIPTION OF THE INVENTION

Figure 1:
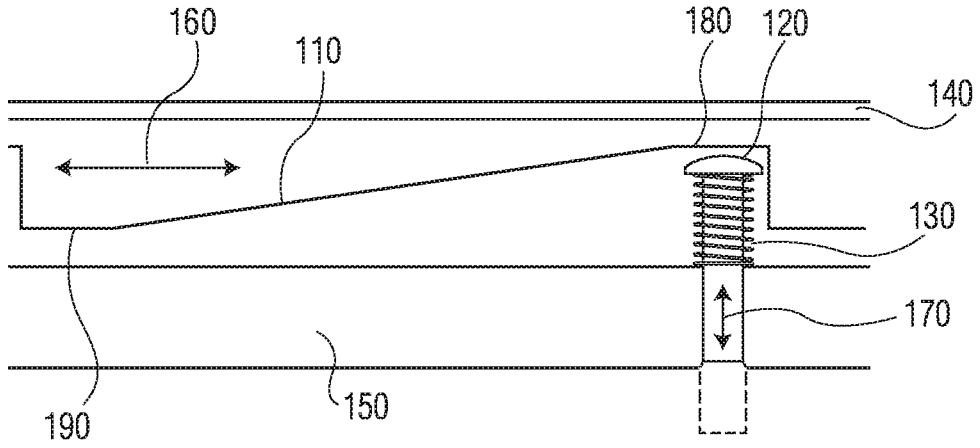
FIG. 1 is a cross sectional side view of a portion of a device showing an inverted ramp and a piston cleat wherein the piston cleat is in a retracted position.

In the following detailed description, reference will be made in detail to the preferred embodiments of the present invention, examples of which are illustrated in the accompanying drawings, which form a part hereof and show by way of illustration embodiments in which the invention may be practiced. These embodiments are described in sufficient detail to enable those skilled in the art to practice the invention, and it is to be understood that other embodiments may be utilized, and that structural, and logical changes may be made without departing from the spirit and scope of the present invention. The progression of processing steps described is exemplary of embodiments of the invention; however, the sequence of steps is not limited to that set forth herein and may be changed as is known in the art, with the exception of steps necessarily occurring in a certain order.

This invention relates to retractable spikes, cleats, studs, or similar protrusions (collectively referred to herein as piston cleats) which have at least a first and second position. In a first position (for example), the piston cleats are housed within the sole of the device such that no portion of the piston cleat is exposed. In a second position (for example), at least a portion of the piston cleat is extended outside the device such that one end of the piston cleat can make contact with a surface. One of ordinary skill in the art would understand that additional positions are available. For example, and without limitation, an embodiment of the invention can include a third position in which a larger portion of the piston cleat is exposed or additional positions in which additional lengths of the piston cleats extend out of the surface. In addition, there are several embodiments of the present invention. In a first embodiment, the device may be attached to the bottom of other footwear owned by the user. When this first embodiment is used, the device containing the piston cleats may be imbedded in a sandal type of sole which is attached by the user to the underside of other shoes or boots. In a second embodiment, the device may be incorporated into the sole of the user's shoe, boot, or other footwear. When the piston cleats consist of "ice" spikes, the purpose of the device is to provide the user with additional traction when walking or running in icy conditions. In a third embodiment, the invention may be embedded into a tire of a car, an ATV, a bicycle, or other wheeled vehicles such that the piston cleats may be retracted into the tire or extended such that a portion of the piston cleats are extended out beyond the surface of the tire. In a fourth embodiment, the need for a spring is eliminated through the use of a ramp channel. One of ordinary skill in the art would appreciate that other embodiments are possible and within the scope of this invention.

The current invention solves the problems described by permitting the user to extend or retract piston cleats easily and nearly instantaneously whenever extension of the piston cleats is advisable or desired.

In most embodiments the present invention does not use gears to retract or expose the piston cleats. Rather, the present invention employs a system of angled inverted ramps within channels to deploy the piston cleats. In a retracted position, the highest point of the ramp is positioned above the piston cleat such that the ramp is not causing a portion of the piston cleat to protrude outside the device. In this position a compression spring helps to ensure that no portion of the piston cleat protrudes outside the device. In an extended position, the lowest point of the ramp is positioned above the piston cleat such that the ramp is causing a portion of the piston cleat to protrude outside the device. In this position, the compression spring is compressed. One of ordinary skill in the art would appreciate that other positions are possible, such as the piston cleats extending, for example, a quarter of an inch, three eights of an inch, a half inch, five eights of an inch, etc. These different positions could be implemented by including additional positions on the inverted ramp. In some embodiments a compression spring is not needed.

FIG. 1 is a cross sectional side view of a portion of the device showing an inverted ramp 110, a piston cleat 120, a compression spring 130, a top cover 140, and a portion of the sole 150. As shown, inverted ramp 110 includes a highest portion 180, a lowest portion 190 and a sloping ramp between the highest portion 180 and the lowest portion 190. As shown, piston cleat 120 includes a rounded head and a cylindrical bottom. FIG. 1 also shows the direction of movement 160 of the inverted ramp 110 and the direction of movement 170 of the piston cleat 120. In the configuration shown in FIG. 1, the inverted ramp 110 is in a retracted position, in which the highest portion 180 of inverted ramp 110 is positioned over piston cleat 120. When the highest portion 180 of inverted ramp 110 is positioned over piston cleat 120, compression spring 130 is in its extended position thus ensuring that no portion of piston cleat 120 extends below the bottom of sole 150. The piston cleat 120 extends through a hole in the bottom of sole 150. Top cover 140 advantageously secures inverted ramp 110, piston cleat 120, and compression spring 130 in place and onto sole 150. Compression spring 130 is positioned around the longitudinal axis of the piston cleat 120.

Figure 2:
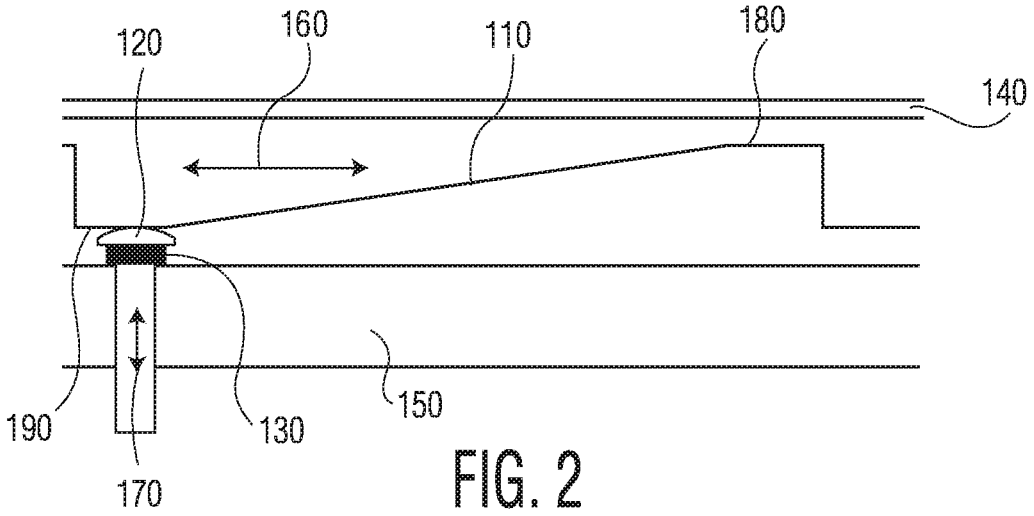
FIG. 2 is a cross sectional side view of a portion of a device showing an inverted ramp and a piston cleat wherein the piston cleat is in an extended position.

FIG. 2 is a cross sectional side view of a portion of the device again showing inverted ramp 110, piston cleat 120, compression spring 130, top cover 140, and the portion of the sole 150. In the configuration shown in FIG. 2, the inverted ramp 110 is in an extended position, in which the lowest portion 190 of inverted ramp 110 is positioned over piston cleat 120. When the lowest portion 190 of inverted ramp 110 is positioned over piston cleat 120, compression spring 130 is in its compressed configuration and a portion of piston cleat 120 extends below the bottom surface of sole 150. One of ordinary skill in the art would appreciate that inverted ramp 110 could include additional positions which would ensure that different lengths of the piston cleat are extended beyond the surface of sole 150. One way to include additional positions is to include additional tiers (or positions) on the inverted ramp allowing the activation arm to stop at different intervals corresponding to different lengths of cleat extension.

Figure 3:
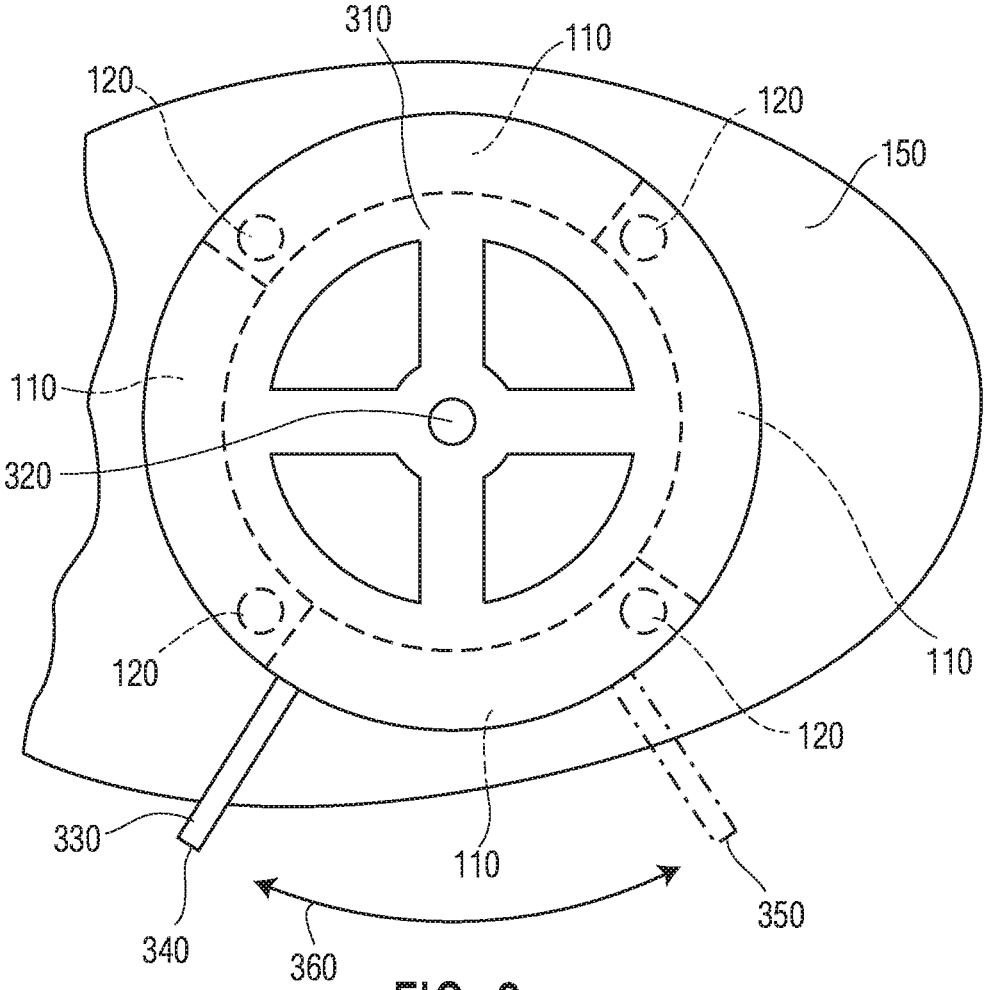
FIG. 3 is top down view of the forefoot portion of a shoe including one embodiment of the invention.

FIG. 3 is an overhead view of the forefoot portion of the device installed in a shoe with the top cover removed. Several inverted ramps 110 (FIG. 3 shows the underside of the inverted ramps) and piston cleats 120 (FIG. 3 shows the tops of the piston cleats which are located below the inverted ramps) may be aligned in a pattern to work in cooperation with a coordinating device. When a coordinating device is included, all such piston cleats 120 are then moved up and down simultaneously (or near simultaneously). FIG. 3 shows the top portion of four piston cleats 120, the non-ramped portion (the top portion) of four inverted ramps 110, in which the four inverted ramps 110 are configured in a coordinating device such as circular disc 310 centered around fixed center axle 320. Also shown in FIG. 3 is a lever arm 330 which can be moved by the user between a first position 340 and a second position 350 along arc 360. In this configuration lever arm 330 extends out of a slot from the side of surrounding sole area 150. In one position of lever arm 330 (for example in a first position 340), each of the four piston cleats 120 are in the retracted position and each of the four respective compression springs (not shown in FIG. 3) are in their extended configuration. In a second position of lever arm 330 (for example in a second position 350), each of the four piston cleats 120 are in their extended position and each of the four respective compression springs (not shown in FIG. 3) are in their retracted (or compressed) configuration. One of ordinary skill in the art would appreciate that additional positions could be added such that each position corresponds to different lengths of the piston cleats extending below the surface. Additionally, the use of the circular disc 310 (which includes an inverted ramp for each piston cleat) ensures that each of the piston cleats 120 extends at the same time (or nearly the same time), when the lever arm 330 is moved from the retracted position to the extended position. One of ordinary skill in the art would appreciate that, alternatively, first position 340 of lever arm 330 could correspond to the extended position of each of the four piston cleats 120 and where the second position 350 of lever arm 330 could correspond to the retracted position of each of the four piston cleats 120. One of ordinary skill in the art would also understand that the device could include additional, or fewer, piston cleats than the four piston cleats 120 shown in FIG. 3. Additionally, one of ordinary skill in the art would appreciate that the circular disc 310 could be replaced with other designs or shapes. For example, the four inverted ramps could be configured into other shapes, including but not limited to, a square, a triangle, or other shapes so long as the inverted ramps were positioned such that movement of the shape would cause the piston cleats to transition from the retracted to the extended positions and that, movement of the shape in the other direction, along with the associated compression springs would cause the piston cleats to transition from their extended positions to the retracted positions. Additionally, one of ordinary skill in the art would appreciate that inverted ramps can be attached to one another. Finally, one of ordinary skill in the art would appreciate that devices other than the lever arm 330 shown can be used to transition the piston cleats between their retracted and their extended positions. For example, and without limitation, the circular disc 120 could include ridges or other configurations (rather than the lever arm 330) that the user may operate to transition the piston cleats between states.

Figure 4:
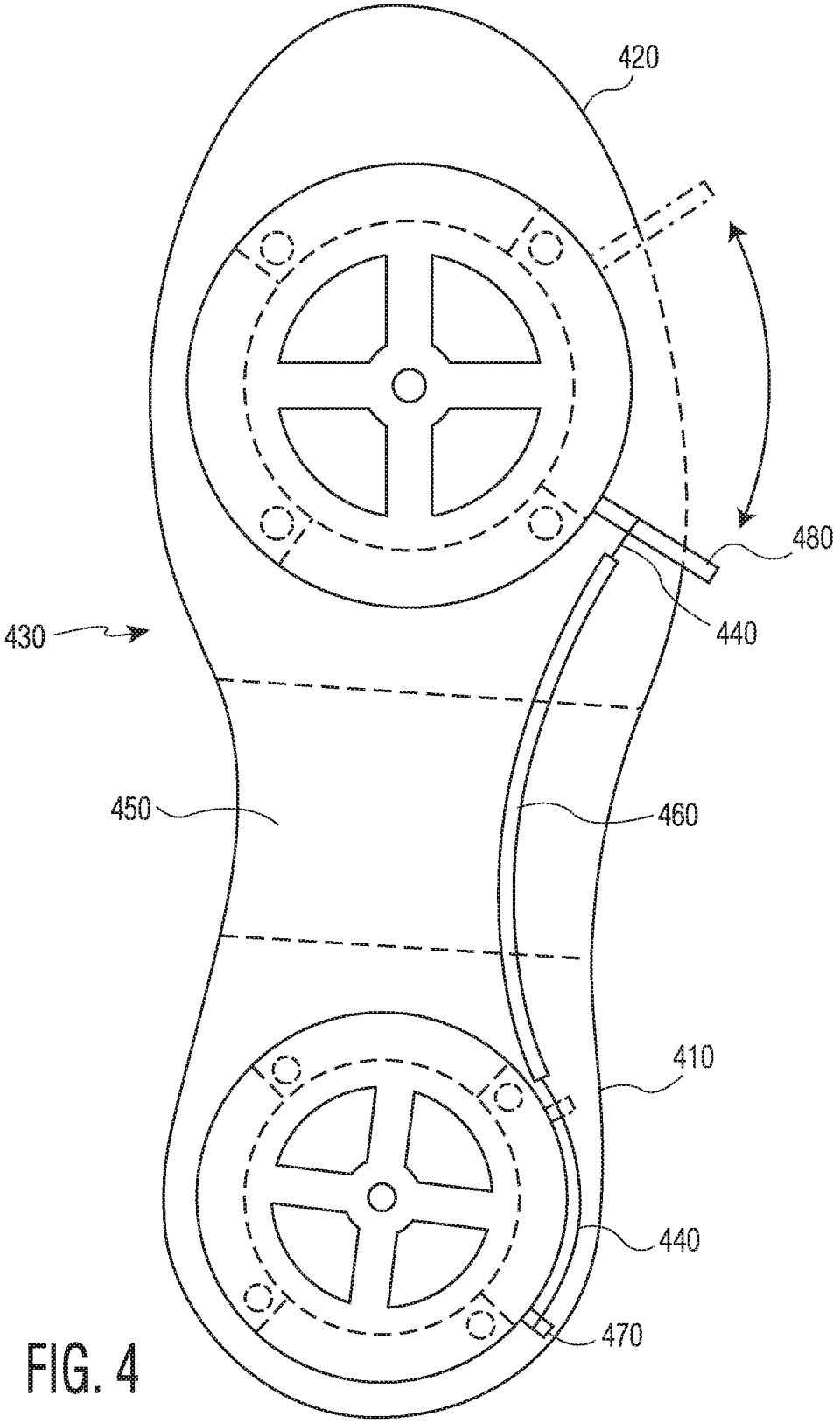
FIG. 4 shows the relative positioning of heel and forefoot mechanisms and the path of a cable connecting them.

FIG. 4 shows the relative positioning of mechanisms placed in both the heel 410 and the toe 420 of a shoe 430 including a cable 440 connecting the lever (470 and 480) for each of the mechanisms. The mechanisms located in the heel 410 and toe area 420 are separated by and connected to a, for example, rubber (or similar) central section 450 allowing both heel and toe to flex as a shoe or boot does. This complete device would typically be attached to the bottom of a shoe or boot much like a sandal using conventional straps to secure the device to such footwear. The device can also be incorporated as a permanent component entirely within the sole of a boot or shoe. The heel mechanism lever arm 470 can be connected to the toe lever arm 480 by a cable 440 within fixed sleeve 460 allowing a finger movement of the toe lever arm 480 alone to move all piston cleats in the heel and toe simultaneously (or nearly simultaneously). Alternatively, the heel mechanism lever arm 470 and the toe lever arm 480 may be independently operated by the user (See FIG. 10).

Figure 5A:
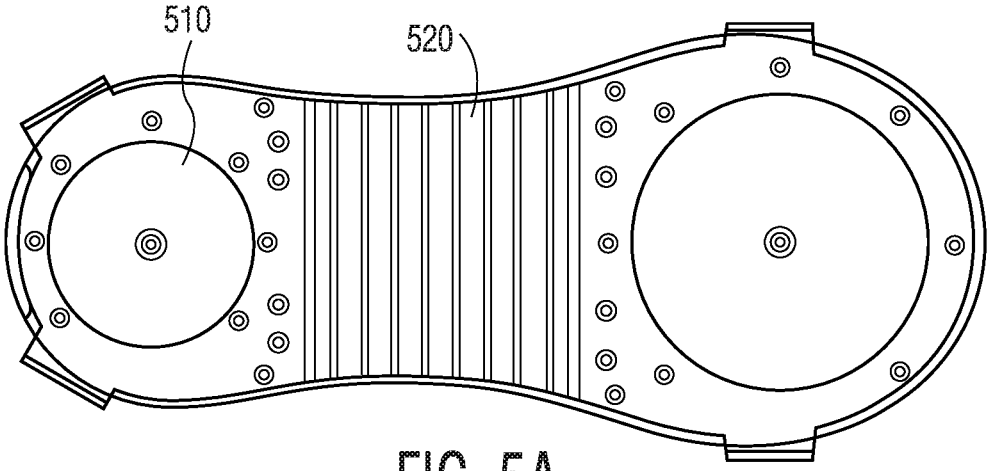
FIG. 5A shows a top portion of a sole of a removable embodiment of the present invention.
Figure 5B:
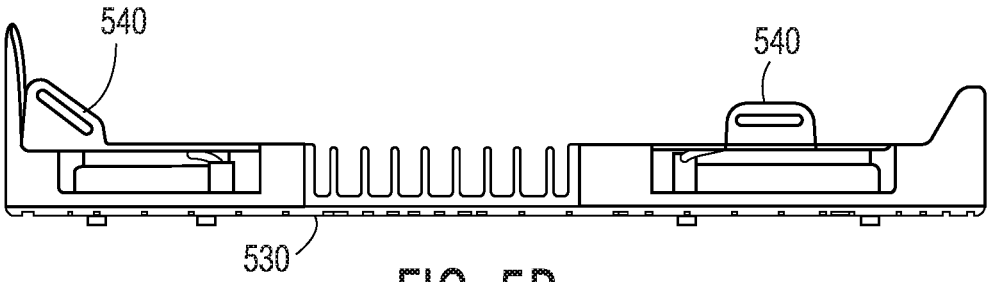
FIG. 5B shows a side view of the removable embodiment of FIG. 5A.
Figure 5C:
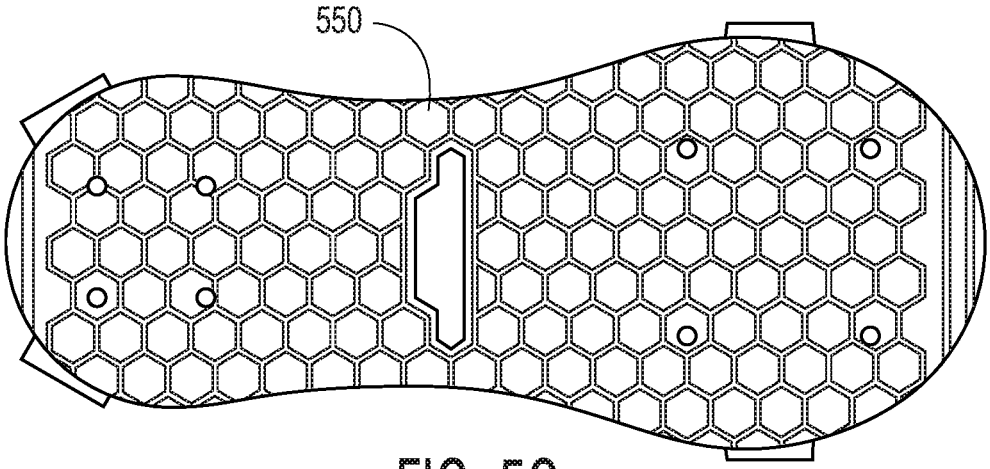
FIG. 5C shows a bottom view of the sole of the removable embodiment of FIG. 5A.
Figure 5D:
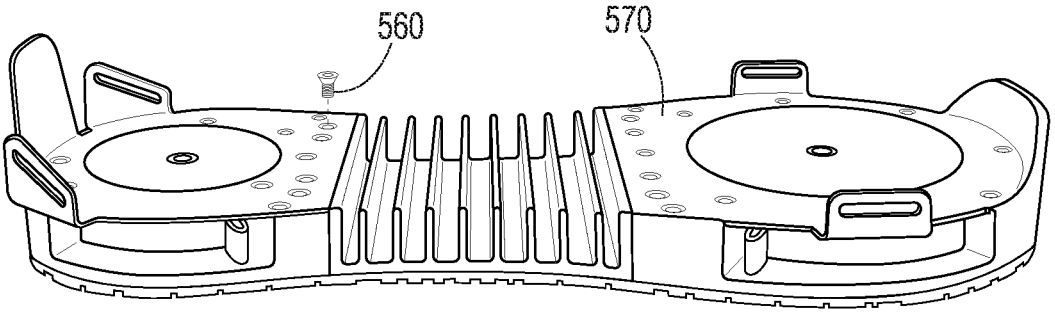
FIG. 5D shows the sole of the removable embodiment of FIG. 5A.
Figure 5E:
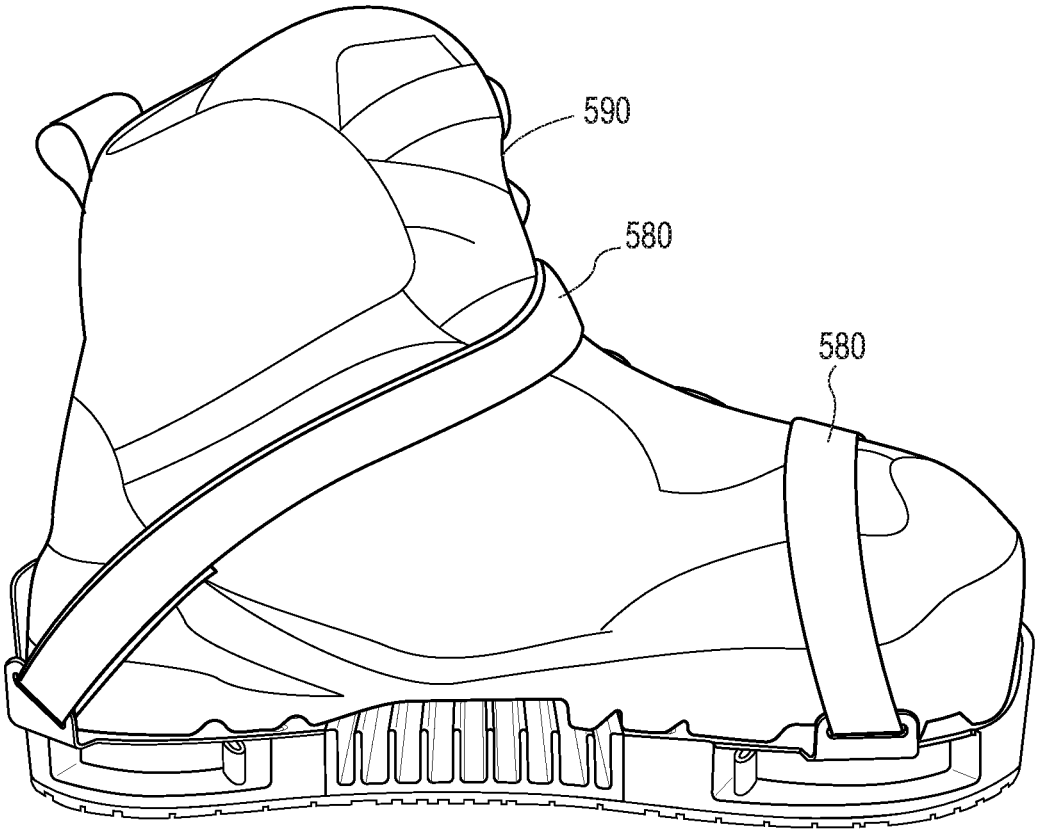
FIG. 5E shows the removable embodiment of FIG. 5A.

FIGS. 5A-5E show various views of a removable embodiment of the present invention. FIG. 5A shows a top portion of the sole, FIG. 5B shows a side view of the sole; FIG. 5C shows a bottom view of the sole; FIG. 5D shows the sole; and FIG. 5E shows the removable embodiment (similar to a sandal) encompassing a shoe. The removable embodiment may include peel and stick grip tape 510 to improve the traction between the removable embodiment and the footwear 590 (FIG. 5E) worn by the user; rigid rubber/flexible plastic connector piece 520 to connect the heel portion with the toe portion; a low profile tread 530, eyelets 540 for the attachment of straps to the removable embodiment, a tread pattern on the bottom of the sole 550, screws 560 for attaching a top cover 570 to the removable embodiment, and straps 580.

Figure 6:
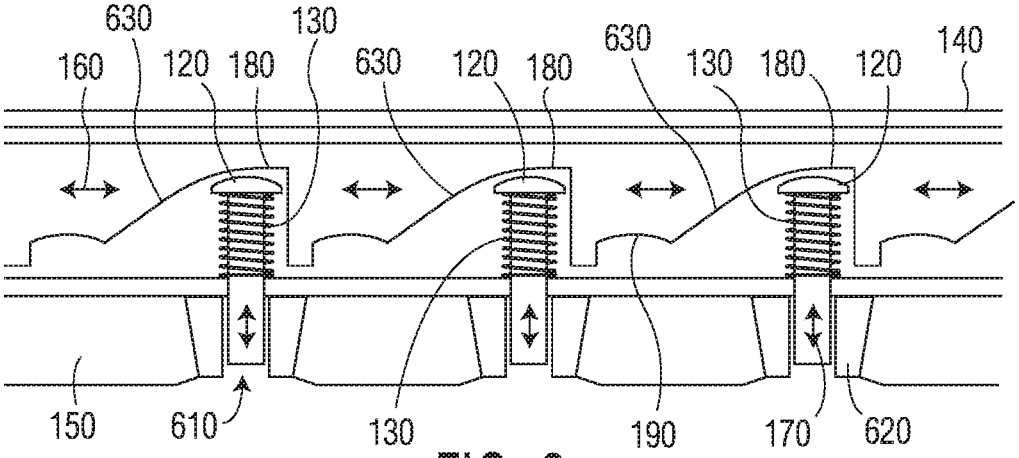
FIG. 6 shows a cross sectional side view of a portion of an embodiment of the device including three piston cleats.

FIG. 6 shows a cross sectional side view of a portion of an embodiment of the device including three piston cleats. FIG. 6 shows three inverted ramps 630, three piston cleats 120, three compression springs 130, a top cover 140, and a portion of the sole 150. When extended. each of the piston cleats 120 shown in FIG. 6 extend through a hole 610 in the sole 150. The shape of the hole 610 is determined by the type or types of compatible cleats. For example, if a device is made to accept both football cleats and ice spikes, the holes 610 would be shaped to accommodate the football cleats because then piston cleats for use with ice and piston cleats for use on football fields would both fit through holes 610. FIG. 6 also shows the direction of movement 160 of the inverted ramps 630 and the direction of movement 170 of the piston cleats 120. Moreover, FIG. 6 also includes cylindrical sleeves 620 to maintain the position of the piston cleats 120 within sole 150. In the configuration shown in FIG. 6, the inverted ramps 630 are in a retracted position, in which the highest portions 180 of inverted ramps 630 are positioned over piston cleats 120. When the highest portions 180 of inverted ramps 630 are positioned over piston cleats 120, compression springs 130 are in their extended configuration thus ensuring that no portion of piston cleats 120 extend below the bottom of sole 150. Top cover 140 advantageously secures inverted ramps 630, piston cleats 120, and compression springs 130 in place onto sole 150. As clearly shown in FIG. 6, the inverted ramps may take on other shapes rather than those shown in FIGS. 1 & 2. The inverted ramps may be configured in any shape that permits a smooth transition between the various positions of the inverted ramp.

Figure 7:
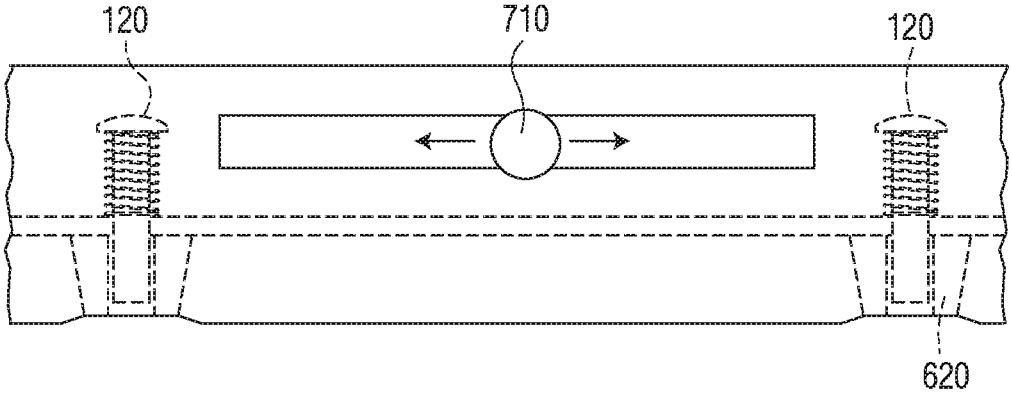
FIG. 7 shows a side view of a switching mechanism which may be used to retract or extend the piston cleats.

FIG. 7 shows a side view of a lever arm (or switching mechanism) 710 which may be used to retract or extend the piston cleats 120. FIG. 7 also shows another view of the optional cylindrical sleeves 620. FIG. 7 does not show the inverted ramps positioned above each of the piston cleats 120.

Figure 8:
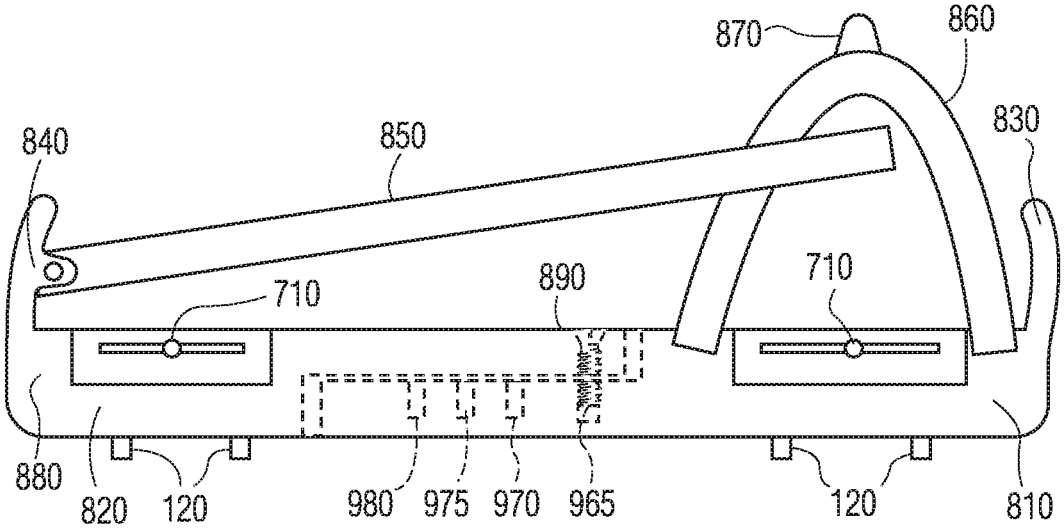
FIG. 8 shows a side view of another removable embodiment of the present invention.

FIG. 8 shows a side view of another removable embodiment of the present invention. The removable embodiment of FIG. 8 includes a toe section 810, a heel section 820, a toe stop 830, a heel stop/strap connection 840, an adjustable heel strap 850, an U-shaped strap 860, and a release tab 870. Also included in FIG. 8 are lever arms (or switching mechanisms) 710, and the tips of the piston cleats 120 extending beyond the sole 880. FIG. 8 also shows a length adjustable mechanism 890 which includes a length adjusting screw which mates with one of several openings to change the overall length of the device.

Figure 9:
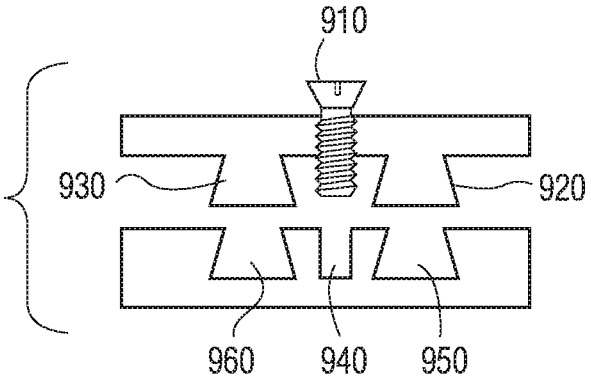
FIG. 9 shows an end view of a toe and heel section of an embodiment of the present invention.

FIG. 9 shows a toe and end view of a heel section highlighting a first and second portion of the length adjustable mechanism 890. The top portion of FIG. 9 includes a length adjusting screw 910, a first wedge 920 and a second wedge 930.

The bottom portion of FIG. 9 shows an end view of a toe section highlighting a second portion of the length adjustable mechanism 890 including an opening 940 to accommodate the length adjusting screw 910, and two wedge openings 950 and 960 to accommodate the first wedge 920 and second wedge 930 respectively. Multiple openings 965, 970, 975, and/or 980 (FIG. 8) may be included within the sole portion 880 to accommodate the length adjusting screw 910 and to adjust the length of the device. Wedge openings would also be included (not shown) to accommodate the first wedge 920 and the second wedge 930 for each corresponding opening 965, 970, 975, 980.

Figure 10:
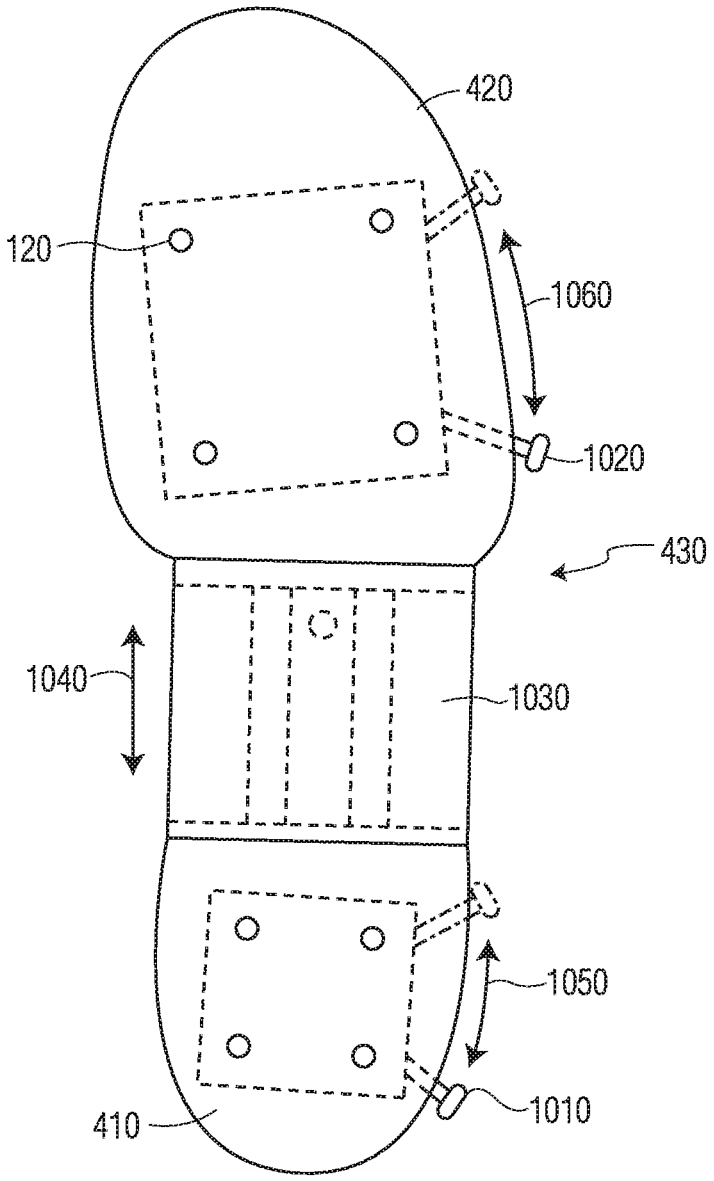
FIG. 10 shows a bottom view of an embodiment which permits adjustment of the length of the device.

FIG. 10 shows a bottom view of an embodiment which permits adjustment of the length of the device. FIG. 10 also shows the relative positioning of mechanisms placed in both the heel 410 and the toe 420 of a shoe 430 including individual lever arms 1010 (for the piston cleats located in the heel area 410) and 1020 (for the piston cleats located in the toe area 420). The mechanisms located in the heel 410 and toe area 420 are separate and not connected. In another embodiment these mechanisms are connected together (See FIG. 4). This complete device would typically be attached to the bottom of a shoe or boot much like a sandal using conventional straps to secure the device to such footwear. The device can also be incorporated as a permanent component entirely within the sole of a boot or shoe. FIG. 10 also shows the interlocking sections which permit the length of the device to change 1030 in the direction shown by double headed arrow 1040. Lever arm 1010 may be moved along arc 1050 and lever arm 1020 may be moved along arc 1060.

In other embodiments, the retractable piston cleats may be incorporated in other items such as, but not limited to, automobile tires, bicycle tires, and all terrain vehicle (ATV) tires. In these embodiments, the invention is incorporated similarly as described above with inverted ramps including a high portion and a low portion of the inverted ramp and a lever arm to transition the lever arm (or a similar device) between the high portion and the low portion being positioned over the piston cleat. In these embodiments, the level arm may be replaced with a screw (or similar device) such that when the screw is turned, the position of the inverted ramp is changed. In another embodiment, the lever arm may be replaced with an air bladder such that when air is introduced into the air bladder, the ends of the piston cleats are extended beyond the surface of the tire. In addition, in these embodiments, the piston cleats may be divided between several different lever arms such that a portion of the piston cleats may be extended (or retracted) at a time. For example, and without limitation, the piston cleats may be divided between four different lever arms in each tire so that the piston cleats on the portion of the tire that is not touching the ground (such as a driveway or a roadway) may be extended without affecting the piston cleats in the portion of the tire that is touching the ground. In this way, a portion of the piston cleats may be extended and then, once the car is moved a short distance, the other piston cleats on that tire may also be extended. Alternatively, the car, or a portion of the car, may be lifted up off of the ground, by way of a lift or a car jack, such that all of the piston cleats on the tire that is no longer touching the ground may be extended at one time.

Figure 11A:
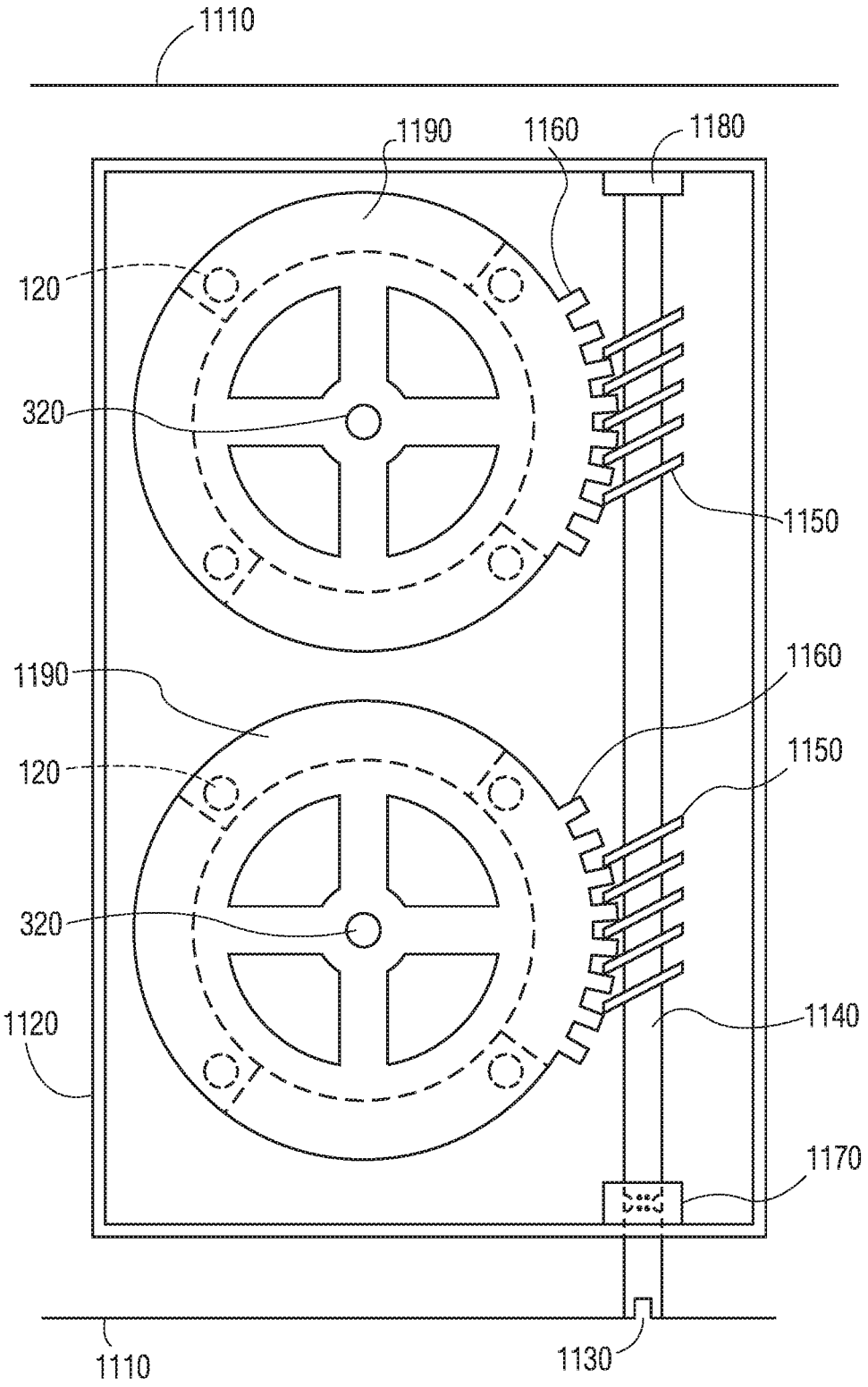
FIG. 11A shows an overhead view (cutaway) of a tire which incorporates one embodiment of the piston cleats of the present invention.

FIG. 11A shows an overhead view (cutaway) of a tire which incorporates one embodiment of the piston cleats of the present invention. This embodiment shows the sidewalls of the tire 1110, a box 1120 (for example, a metal box) which completely surrounds and protects the majority of the components of the retractable piston cleat system, a screw driver insert 1130 at the end of an activation rod 1140, teeth 1150 attached to the circular disc 1190, which meshes with worm gears 1160 which are attached to activation rod 1140. In this embodiment, screw driver insert 1130, activation rod 1140, teeth 1150 and worm gears 1160 are used to expose or retract piston cleats 120 and replace the lever arm described in other embodiments. Activation rod 1140 is held in position by forward stabilizer 1170 and rear stabilizer 1180. A stop (not pictured) may be included in either, or both, stabilizers 1170 and 1180 to prevent activation rod 1140 from becoming unattached to stabilizers 1170 and 1180. Activation rod 1140 and stabilizers 1170 and 1180 may include matching threads to ensure precise coordination between activation rod 1140 and stabilizers 1170 and 1180. In operation, after mating a screw driver with screw driver insert 1130, the user turns the screw driver (clockwise or counterclockwise) which turns screw driver insert 1130 in the same direction thereby turning activation rod 1140 in the same direction, and causes worm gears 1160 to interact with teeth 1150 which are attached to circular disc 1190. When worm gears 1160 interact with teeth 1150, circular disc 1190 turns which causes the piston cleats to be retracted or extended. The interaction between the turning of the circular disc 1190 and the extension/retraction of the piston cleats is explained the same as, or substantially the same as previously with respect to the descriptions of FIGS. 1-3. The screw driver insert 1130 may be replaced with other devices such as, but not limited to, a head of a bolt which can be turned using a socket and a ratchet.

Figure 11B:
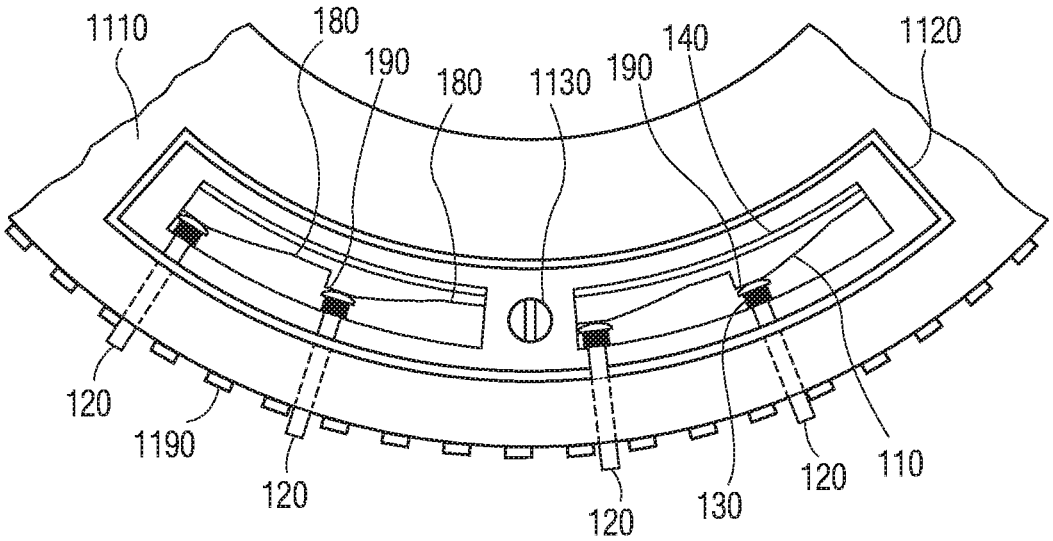
FIG. 11B shows a sideview of a tire including the embodiment of the invention shown in FIG. 11A.

FIG. 11B shows a sideview of the embodiment of the invention shown in FIG. 11A. In FIG. 11B, a curved metal box 1120 is clearly shown. FIG. 11B also shows the inverted ramps 110, piston cleats 120, compression springs 130, and top covers 140. In the configuration shown in FIG. 11B, the inverted ramps 110 are in extended positions, in which the lowest portions 190 of inverted ramps 110 are positioned over piston cleats 120. When the lowest portions 190 of inverted ramp 110 are positioned over piston cleats 120, compression springs 130 are in their compressed configurations and portions of piston cleats 120 extends outside the tire. One of ordinary skill in the art would appreciate that inverted ramps 110 could include additional positions which would ensure that different lengths of the piston cleats can be extended outside the tire 1190.

Figure 12:
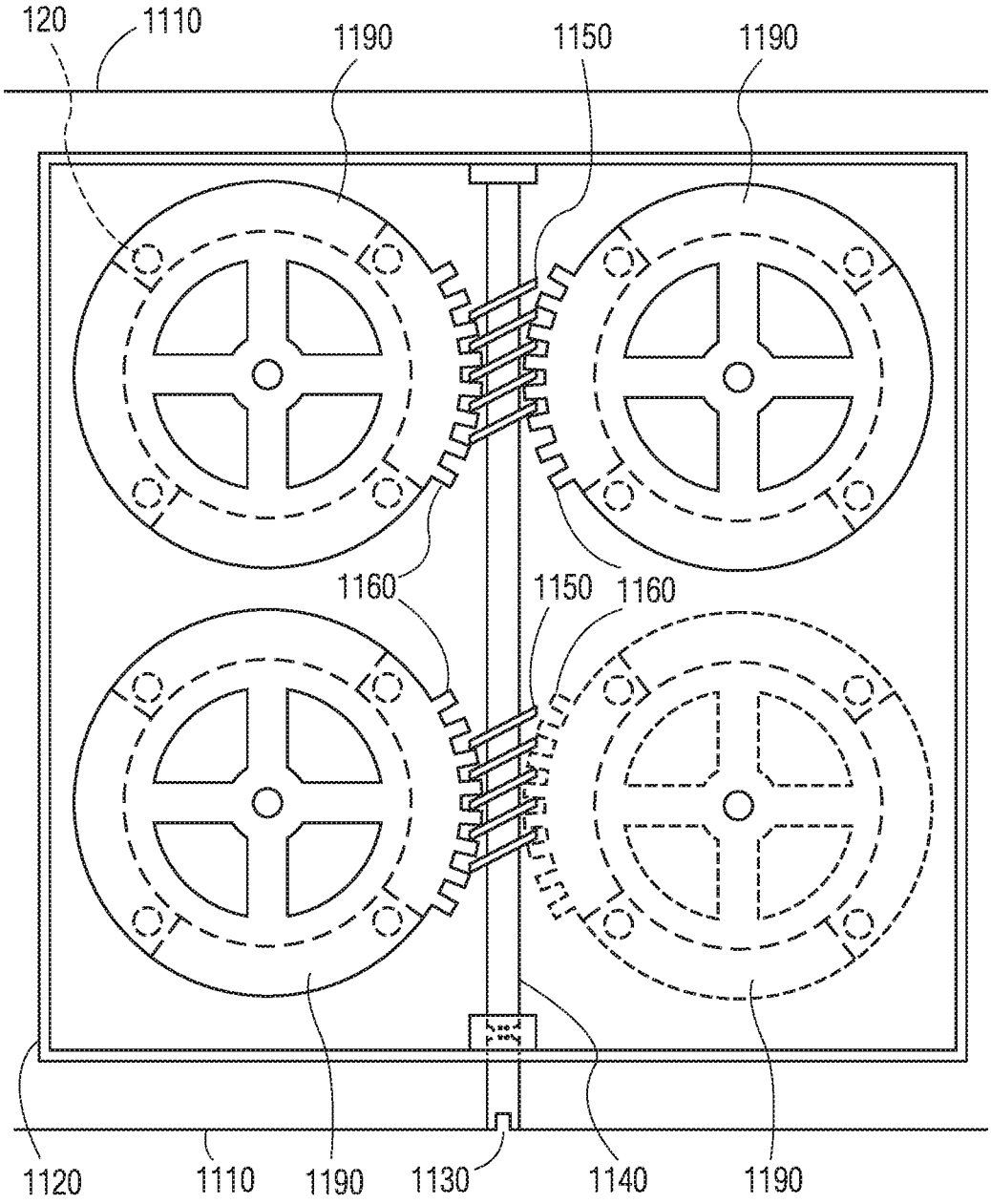
FIG. 12 shows an overhead view (cutaway) of a tire which incorporates another embodiment of the piston cleats of the present invention.

FIG. 12 shows an overhead view (cutaway) of a tire which incorporates another embodiment of the piston cleats of the present invention. This embodiment is similar to the embodiment described in FIG. 11A, except in this case the activation rod 1140 is activating four circular discs 1190 rather than the two circular discs shown in FIG. 11A.

Figure 13:
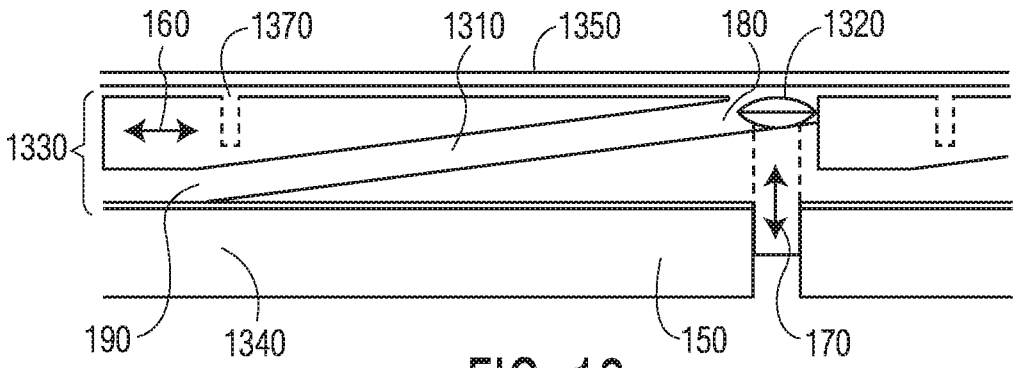
FIG. 13 is a cross sectional side view of a portion of another embodiment of the device showing a ramp channel and piston cleat with an oblong head wherein the piston cleat is in a retracted position.

FIG. 13 is a cross sectional side view of a portion of another embodiment of the device showing a ramp channel 1310 and piston cleat with an oblong head 1320. In this embodiment, the compression spring included in other embodiments is replaced with the ramp channel 1310 and the oblong head of the piston cleat 1320 which travels along the length of the ramp channel 1310. Use of the ramp channel minimize the friction and permits variable finger pressure to handle any changes in resistance. As shown in FIG. 13 the piston cleat with the oblong head 1320 is in a retracted position (i.e., no part of the piston cleat with the oblong head 1320 extends down below the bottom of the sole of the shoe). FIG. 13 also shows a disc core 1330, a cast housing 1340, a flat metal top 1350, and a portion of the sole 150. As shown, ramp channel 1310 includes a highest portion 180, a lowest portion 190 and a sloping ramp between the highest portion 180 and the lowest portion 190. As shown, piston cleat with an oblong head 1320 includes an oblong head and a cylindrical bottom. FIG. 13 also shows the direction of movement 160 of the ramp channel 1310 and the direction of movement 170 of the piston cleat with an oblong head 1320. In the configuration shown in FIG. 13, the ramp channel 1310 is in a retracted position, in which the highest portion 180 of ramp channel 1310 is positioned over piston cleat with an oblong head 1320. When the highest portion 180 of ramp channel 1310 is positioned over piston cleat with an oblong head 1320, no portion of piston cleat with an oblong head 1320 extends below the bottom of sole 150. The bottom portion of the piston cleat with an oblong head 1320 is capable of extending through a hole in the bottom of sole 150 as described below. Disc core 1330 is the inner half of channel ramp along its outer edge. Cast housing 1340 holds disc core 1330 and flat metal top 1350 in place. Flat metal top 1350 is preferably attached to case housing 1340 and permits disc core 1330 and ring around disc 1360 to rotate in place. Ring around disc 1360 is the outer half of ramp channel 1310 and aligns with the disc core 1330 using pins (or screws) inserted into slots 1370 (see FIG. 15). Notably, this embodiment of the invention eliminates the compression spring described in other embodiments.

Figure 14:
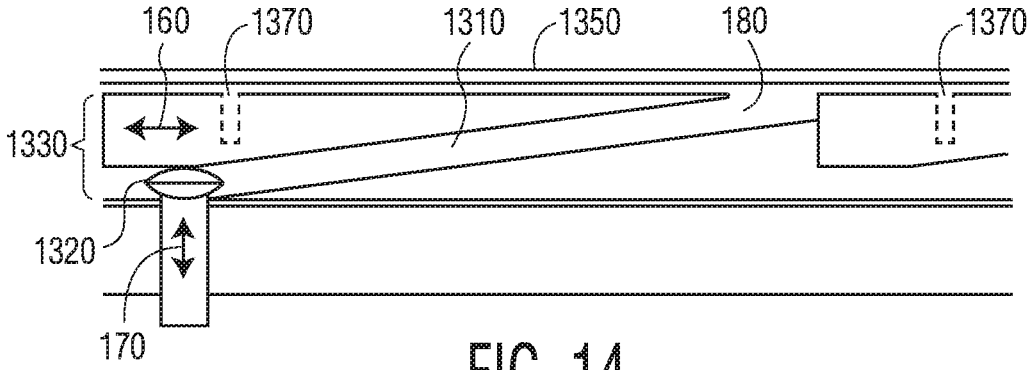
FIG. 14 is a cross sectional side view of a portion of the embodiment of the device shown in FIG. 13 showing a ramp channel and a piston cleat with an oblong head wherein the piston cleat is in an extended position.

FIG. 14 is a cross sectional side view of a portion of the embodiment of the device shown in FIG. 13 showing a ramp channel and a piston cleat with an oblong head 1320 wherein the piston cleat is in an extended position, i.e., a portion of the piston cleat with an oblong head 1320 is extended below the bottom sole of the shoe.

Figure 15:
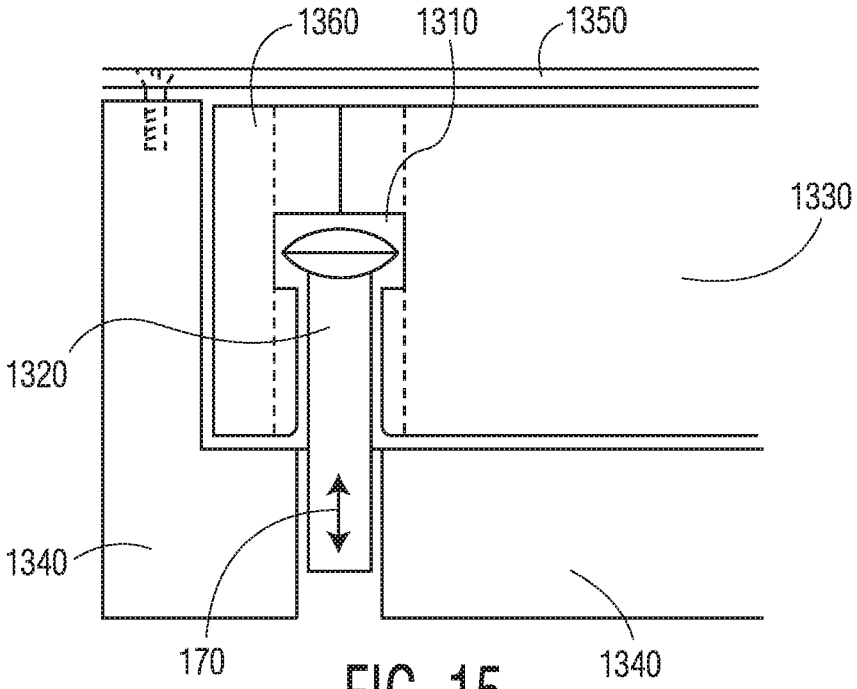
FIG. 15 shows a cross sectional front view of a portion of the embodiment of the device shown in FIG. 13 showing a ramp channel and a piston cleat with an oblong head wherein the piston cleat is in a partially extended position.

FIG. 15 shows a cross sectional front view of a portion of the embodiment of the device shown in FIGS. 13 and 14 showing the ramp channel 1310 and the piston cleat with an oblong head 1320 wherein the piston cleat 1320 is in a partially extended position. FIG. 15 shows the oblong head of the piston cleat 1320 positioned within ramp channel 1310. FIG. 15 also shows the disc core 1330, cast housing 1340, flat metal top 1350, and ring around disc 1360. Also shown in FIG. 15 is a screw (or pin) 1510 inserted in slot 1370 to align ring around disc 1360 with disc core 1330.

Figure 16A:
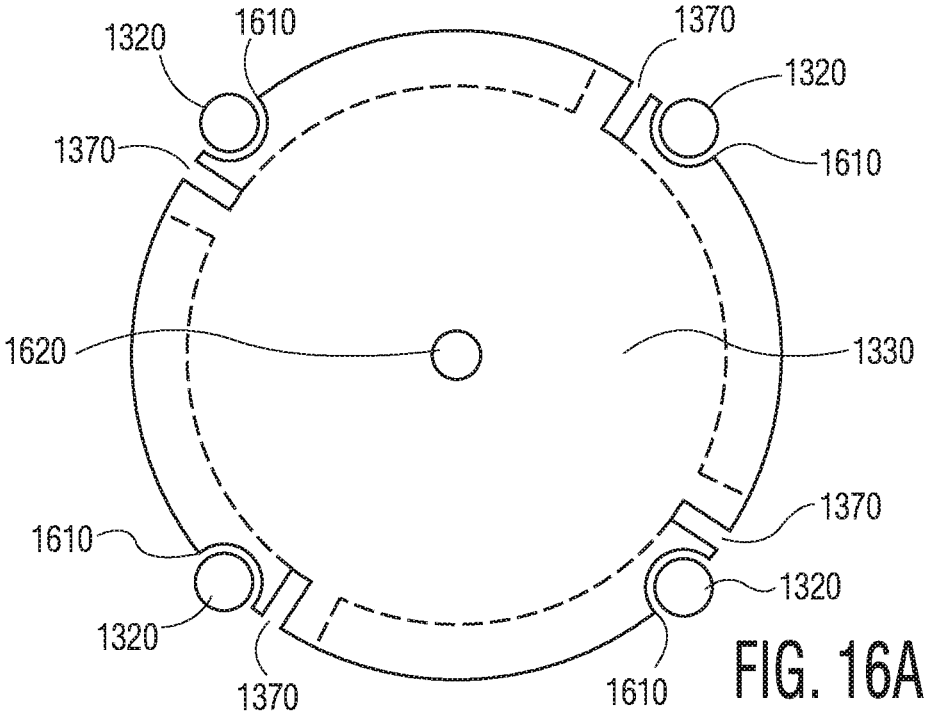
FIG. 16A shows the Disc Core with the inside half of the ramp channel.

FIG. 15 shows the piston cleat 1320 is lowered or raised by means of a sloping channel that moves laterally by means of a hand operated lever arm (FIG. 18) attached to a disc core 1330 encasing such ramp channels 1310 along its outer edge. The ramp channels 1310 hold the top and underside edges of the oblong head of the piston cleat which is slightly larger in diameter than that of the piston cleat underneath the oblong head. The lower portion of the piston cleat 1320 is held in vertical place by a hole in a fixed platform/sole of shoe/sandal allowing the piston cleat 1320 to move only up or down as the ramp channel 1310 is moved with the movement of the disc core 1330. The ramp channel 1310 itself has an inner side on the outer edge of the disc core (FIG. 16A). A ring around disc 1360 (FIG. 16B) containing the outer side of the ramp channel is attached to the disc core 1330 and moves with it as an integral part. A flat metal top 1350 is attached to a side extension of the fixed platform allowing just enough space for the disc core 1330 to spin freely while being held firmly in place by the flat metal top 1350. Disc Core 1330 is an example of a coordinating device.

FIG. 16A shows the Disc Core 1330 with one half side of a ramp channel. The Disc Core 1330 includes openings 1610 in the outer circumference of the Disc Core 1330 to permit installation of the piston cleats with oblong head 1320. When the piston cleat with oblong head 1320 is retracted the top of the piston cleat with oblong head 1320 makes contact with the flat metal top 1350. FIG. 16A shows four slots to receiving positioning screws/pins. One of ordinary skill in the art would appreciate that additional (or fewer) slots and screws/pins may be used.

Figure 16B:
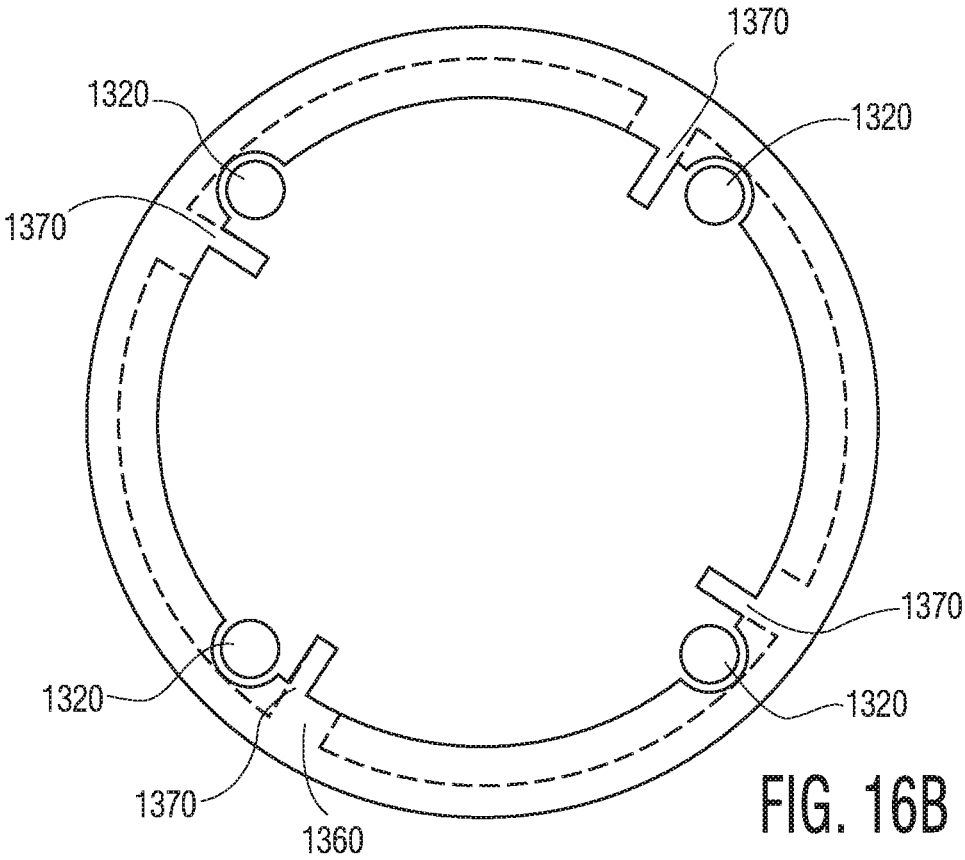
FIG. 16B shows the Ring around the Disc Core with the outside half of the ramp channel.

FIG. 16A shows an overhead view of the Disc Core 1330 showing a center hole 1620 for an axle to spin on and slots 1370 along the edge to mate with pins (or screws) on the inside edge of the ring around disc 1360 in FIG. 16B which holds the outer half of the ramp channel 1310. Semicircular holes at the top of each ramp channel 1310 side are matched together for a round hole allowing the piston cleats with oblong heads 1320 to be installed or removed when the flat metal top 1350 is removed. Dash marks indicate the path of the oblong head of the piston cleats 1320 traveling within the ramp channel 1310.

FIG. 16B shows the Ring Around Disc 1330. Ring Around Disc 1330 provides the outer half of the ramp channel 1310. The Ring Around Disc 1360 is preferably attached to the edge of Disc Core 1330 and it aligns the components of the ramp channel 1310.

Figure 17A:
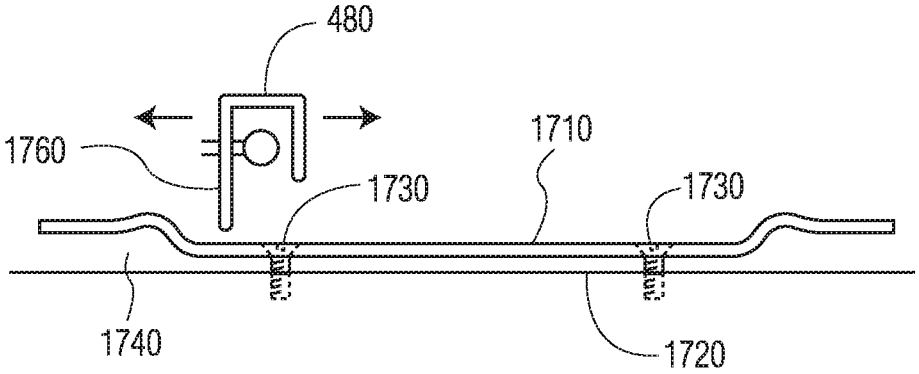
FIG. 17A shows one method (side view) using a spring steel component to keep the toe lever arm in the desired positions of either the extended piston or retracted position mode.
Figure 17B:
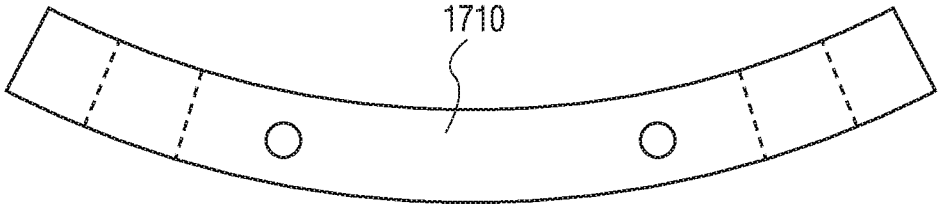
FIG. 17B shows an overhead view of FIG. 17A.

FIG. 17A shows one method to keep the toe lever arm 480 in a desired position. FIG. 17B shows an overhead view of FIG. 17B. In this embodiment a Spring Steel Component 1710 is affixed to the lower end of the Toe Channel 1720 with preferably two screws 1730. A space 1740 is provided between the Spring Steel Component 1710 and the lower end of the Toe Channel 1720 and this space 1740 could be filled with grease (or a similar substance) to repel water and prevent water from entering space 1740. Also shown in FIG. 17A the Toe Lever Arm 480 permits the user to extend or retract the piston cleats with oblong heads 1320. FIGS. 17A and B show a means of keeping the toe lever arm 480 properly in position for either the extended or the retracted mode of operation controlled by the manual movement of a toe lever arm 480 used to rotate the disc core 1330 with ring around disc 1360 component. A small, thin spring steel plate 1710 is attached to the bottom of the ramp channel 1310 which lies under the path of the toe lever arm 480. Bends on either end of the spring steel plate 1710 come in contact with a vertical protrusion 1760 coming downward from the toe lever arm 480. The bends in the spring steel plate 1710 are compressed downward and hold the toe lever arm 480 in place at either end of the toe lever arm's 480 range until moved by finger force.

Figure 18:
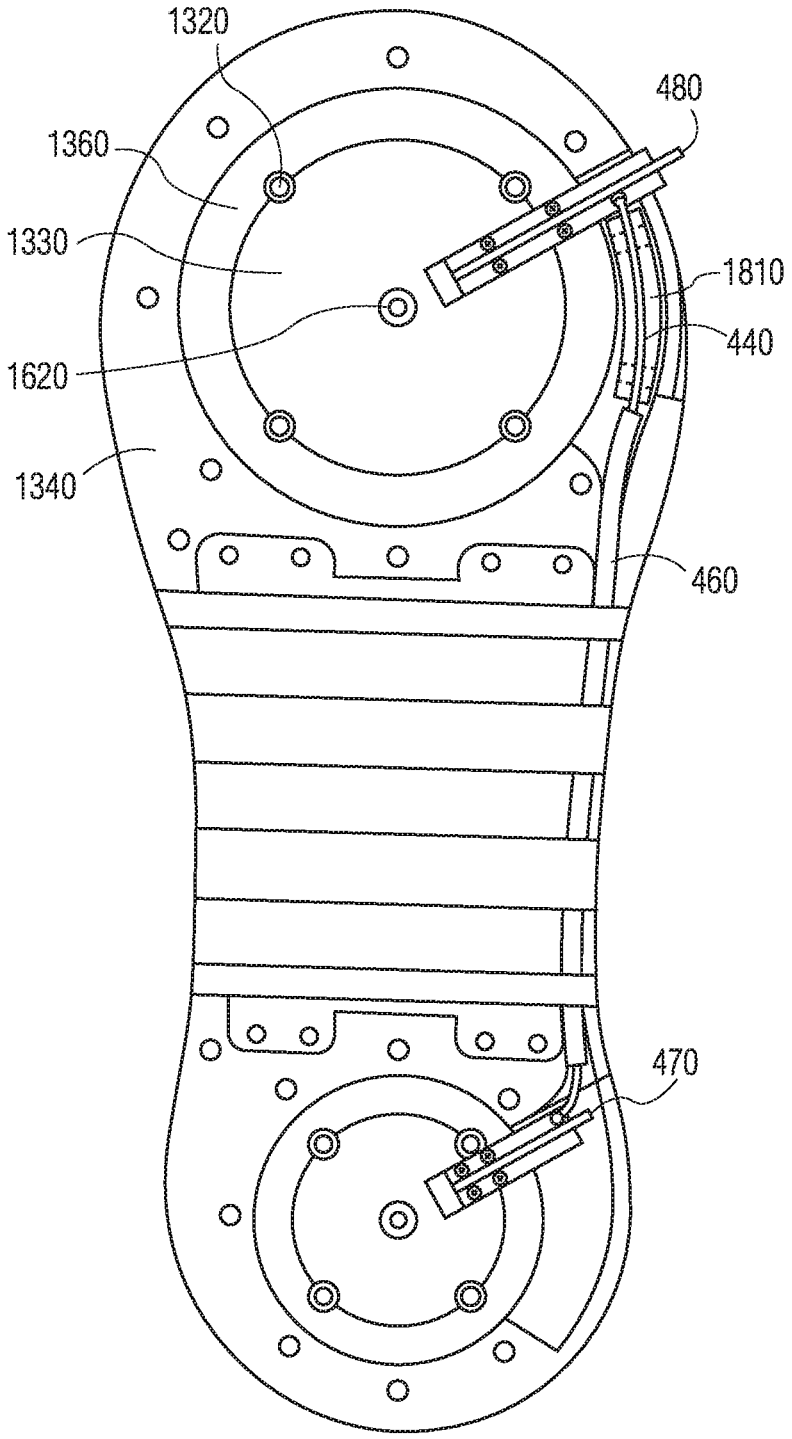
FIG. 18 shows the position under the toe lever arm where FIGS. 17A and B are located.

FIG. 18 shows the position under the toe lever arm 480 where FIGS. 17A and B are located 1810 in the toe section of a shoe or sandal. FIG. 18 shows the location of the spring steel part 1810 in the toe section of a shoe or sandal.

In another embodiment of the invention, the piston cleats may be replaceable with another type of piston cleats. In this embodiment, one pair of shoes may be configured to use soccer cleats, or football cleats by replacing the soccer cleats with football cleats or vice versa. This embodiment would permit the user to own one pair of shoes which permit cleats and then to replace the cleats with cleats for specific activities such as football or soccer. In one "replaceable piston cleat" embodiment, the piston cleats are replaceable by removing the top cover plate and the disc beneath the top cover plate.

While the invention has been particularly shown with reference to specific embodiments, it should be understood by those of ordinary skill in the art that various changes in form and detail may be made therein without departing from the spirit and scope of the invention as defined by the claims. The invention is to cover all modifications, equivalents, and alternatives falling within the spirit and scope of the invention as defined by the claims.

The invention claimed is:

1. A retractable piston cleat system comprising:

at least two ramp channels located in a toe section of a footwear wherein each of said at least two ramp channels located in said toe section of said footwear includes at least a first portion, a second portion and a third portion of each of said at least two ramp channels;

at least two piston cleats located in said toe section of said footwear where each piston cleat located in said toe section of said footwear includes a head wherein each of said heads of said at least two piston cleats located in said toe section of said footwear are positioned within different ramp channels of said at least two ramp channels located in said toe section of said footwear and said at least two piston cleats are not physically connected together;

at least two ramp channels located in a heel section of said footwear wherein each of said at least two ramp channels located in said heel section of said footwear includes at least a first portion, a second portion and a third portion of each of said at least two ramp channels;

at least two piston cleats located in said heel section of said footwear where each piston cleat located in said heel section of said footwear includes a head wherein each of said heads of said at least two piston cleats located in said heel section of said footwear are positioned within different ramp channels of said at least two ramp channels located in said heel section of said footwear and said at least two piston cleats are not physically connected together;

wherein said retractable piston cleat system does not include a spring;

at least two lever arms;

at least two circular disc cores each of said at least two circular disc cores connected to one of said two lever arms, wherein each of said circular disc cores rotates around a different center hole;

wherein one of said two lever arms said connected circular disc cores is located in said toe section of said footwear;

wherein the second of said two lever arms and said connected circular disc cores is located in said heel section of said footwear;

which when each of said lever arms is activated causes each of said circular disc cores to rotate around its respective center hole thereby causing each of said corresponding ramp channels to move with respect to the head positioned within said corresponding ramp channel thereby causing said corresponding piston cleat to either be retracted or extended.

2. The retractable piston cleat system of claim 1 wherein said at least two piston cleats are retracted when said heads of said piston cleats are located in said first portion of said at least two ramp channels.

3. A method of moving a first and a second piston cleat between respective extended positions and retracted positions in a toe section of a footwear, where said first and said second piston cleats are not physically attached to each other, and moving a third and a fourth piston cleat between respective extended positions and retracted positions in a heel section of said footwear, where said third and fourth piston cleats are not physically attached to each other, said method comprising the steps of:

positioning a first ramp channel in said toe section of said footwear such that the head of said first piston cleat is positioned within said first ramp channel;

positioning a second ramp channel in said toe section of said footwear such that the head of said second piston cleat is positioned within said second ramp channel;

connecting a first lever arm in said toe section of said footwear to a first circular disc core in said toe section of said footwear such that movement of said lever arm in said toe section of said footwear causes a rotation of said first circular disc core in said toe section of said footwear and rotation of said first circular disc core in said toe section of said footwear causes movement to said first and second ramp channels located in said toe section of said footwear;

wherein movement of said first lever arm in said toe section of said footwear in a first direction causes said first and second ramp channels in said toe section of said footwear to move such that the heads of said first and second piston cleats are positioned at the highest portion of each of said respective ramp channels located in said toe section of said footwear without the use of a spring;

wherein movement of said first lever arm in said toe section of said footwear in a second direction causes said first and second ramp channels in said toe section of said footwear to move such that the heads of said first and second piston cleats are positioned at the lowest portion of each of said respective ramp channels in said toe section of said footwear;

extending a bottom of each of said first and second piston cleats such that a portion of each of said piston cleats is exposed when the heads of said first and second piston cleats are positioned at the lowest portion of each of said respective ramp channels; and retracting each of said piston cleats such that no portion of each of said piston cleats is exposed when the heads of said first and second piston cleats are positioned at the highest portion of each of said respective ramp channels positioning a third ramp channel in said heel section of said footwear such that the head of said third piston cleat is positioned within said third ramp channel;

positioning a fourth ramp channel in said heel section of said footwear such that the head of said fourth piston cleat is positioned within said fourth ramp channel;

connecting a second lever arm in said heel section of said footwear to a second circular disc core in said heel section of said footwear such that movement of said second lever arm in said heel section of said footwear causes a rotation of said second circular disc core in said heel section of said footwear and rotation of said second circular disc core in said heel section of said footwear causes movement to said third and fourth ramp channels;

wherein movement of said second lever arm in said heel section of said footwear in a first direction causes said third and fourth ramp channels in said heel section of said footwear to move such that the heads of said third and fourth piston cleats are positioned at the highest portion of each of said respective ramp channels without the use of a spring;

wherein movement of said second lever arm in said heel section of said footwear in a second direction causes said third and fourth channels in said heel section of said footwear to move such that the heads of said third and fourth piston cleats are positioned at the lowest portion of each of said respective ramp channels in said heel section of said footwear;

extending a bottom of each of said third and fourth piston cleats such that a portion of each of said piston cleats is exposed when the heads of said third and fourth piston cleats are positioned at the lowest portion of each of said respective ramp channels; and retracting each of said piston cleats such that no portion of each of said piston cleats is exposed when the heads of said first and second piston cleats are positioned at the highest portion of each of said respective ramp channels.

4. The method of claim 3, wherein positioning said heads of said piston cleats at the highest portion of said ramp channels results in the piston cleats being retracted.

5. The method of claim 1 wherein one of said piston cleats can be individually removed.

6. The method of claim 3, further including the step of being able to remove said first piston cleat without removing said second piston cleat.

* * * * *